US011549382B2

(12) United States Patent
Keshavan et al.

(10) Patent No.: US 11,549,382 B2
(45) Date of Patent: Jan. 10, 2023

(54) RESTORATION COATING SYSTEM AND METHOD

(71) Applicant: General Electric Company, Schenectady, NY (US)

(72) Inventors: Hrishikesh Keshavan, Watervliet, NY (US); Ambarish Jayant Kulkarni, Glenville, NY (US); Margeaux Wallace, Niskayuna, NY (US); Byron Andrew Pritchard, Jr., Loveland, OH (US); Almed M. Elkady, Mason, OH (US); Atanu Saha, Bangalore (IN); Mamatha Nagesh, Bangalore (IN); Bernard Patrick Bewlay, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 79 days.

(21) Appl. No.: 17/089,331

(22) Filed: Nov. 4, 2020

(65) Prior Publication Data

US 2021/0131305 A1 May 6, 2021

Related U.S. Application Data

(60) Provisional application No. 62/931,643, filed on Nov. 6, 2019.

(51) Int. Cl.
*F01D 5/28* (2006.01)
*C23C 4/11* (2016.01)
(Continued)

(52) U.S. Cl.
CPC ..... *F01D 5/288* (2013.01); *C23C 4/02* (2013.01); *C23C 4/11* (2016.01); *C23C 4/134* (2016.01);
(Continued)

(58) Field of Classification Search
CPC ..... F01D 5/286; F01D 5/288; F05D 2230/90; F05D 2300/611
(Continued)

(56) References Cited

U.S. PATENT DOCUMENTS 5,660,885 A 8/1997 Hasz et al.
5,685,917 A * 11/1997 Sangeeta ..... C23G 5/00 134/29
(Continued)

FOREIGN PATENT DOCUMENTS

CN 1584297 A * 2/2005 ..... C23C 28/3215
CN 101024880 A * 8/2007 ..... C23C 28/321
(Continued)

OTHER PUBLICATIONS

First Search for CN Application 2020112306140, dated May 27, 2022. (Year: 2022).*
(Continued)

*Primary Examiner* — Topaz L. Elliott
(74) *Attorney, Agent, or Firm* — Fitch, Even, Tabin & Flannery LLP

(57) ABSTRACT

A coated component of a gas turbine engine includes a substrate defining a surface, a thermal barrier coating deposited on the surface of the substrate, a region of the component where the thermal barrier coating has spalled from the substrate, a layer of environmental contaminant compositions formed on one or more of the thermal barrier coating or the region of the component where the thermal barrier coating has spalled from the substrate in response to an initial exposure of the component to high operating temperatures of the gas turbine engine, and a thermal barrier coating (TBC) restoration coating deposited at least on the region of the component where there thermal barrier coating has spalled from the substrate.

18 Claims, 2 Drawing Sheets

(51) Int. Cl.
*C23C 4/02* (2006.01)
*C23C 4/134* (2016.01)

(52) U.S. Cl.
CPC ..... *F05D 2220/32* (2013.01); *F05D 2230/31* (2013.01); *F05D 2230/90* (2013.01); *F05D 2260/231* (2013.01); *F05D 2300/611* (2013.01)

(58) Field of Classification Search
USPC ..... 416/241 R, 241 B
See application file for complete search history.

(56) References Cited

U.S. PATENT DOCUMENTS

| | | | | |
|---|---|---|---|---|
| 5,723,078 | A | 3/1998 | Nagaraj et al. | |
| 5,851,678 | A | 12/1998 | Hasz et al. | |
| 6,010,746 | A | 1/2000 | Descoteaux et al. | |
| 6,294,261 | B1 * | 9/2001 | Sangeeta | C23C 10/18 416/241 B |
| 6,465,090 | B1 | 10/2002 | Stowell et al. | |
| 6,794,059 | B2 * | 9/2004 | Shanker | C23C 28/321 416/241 B |
| 6,919,121 | B2 | 7/2005 | Stowell et al. | |
| 7,579,087 | B2 | 8/2009 | Maloney et al. | |
| 8,221,825 | B2 | 7/2012 | Reitz et al. | |
| 8,356,482 | B2 | 1/2013 | Duval et al. | |
| 8,470,460 | B2 | 6/2013 | Lee | |
| 8,758,502 | B2 | 6/2014 | Nienburg et al. | |
| 9,096,736 | B2 | 8/2015 | Tanaka et al. | |
| 10,221,703 | B2 * | 3/2019 | Sivaramakrishnan | F01D 5/288 |
| 10,364,701 | B2 | 7/2019 | Keshavan et al. | |
| 10,384,978 | B2 | 8/2019 | Mcevoy et al. | |
| 2003/0138659 | A1 * | 7/2003 | Shanker | C23C 28/3455 428/701 |
| 2003/0221315 | A1 | 12/2003 | Baumann et al. | |
| 2005/0228098 | A1 * | 10/2005 | Skoog | C23C 28/3215 427/140 |
| 2007/0063351 | A1 | 3/2007 | Duda et al. | |
| 2007/0202269 | A1 | 8/2007 | Potter et al. | |
| 2009/0169752 | A1 | 7/2009 | Fu et al. | |
| 2009/0252985 | A1 | 10/2009 | Nagaraj et al. | |
| 2010/0136349 | A1 | 6/2010 | Lee | |
| 2010/0242477 | A1 * | 9/2010 | Duval | C23C 28/30 427/427 |
| 2011/0059321 | A1 * | 3/2011 | Skoog | F01D 5/288 427/140 |
| 2016/0195272 | A1 | 7/2016 | Tu et al. | |
| 2016/0273114 | A1 | 9/2016 | Hongoh | |
| 2016/0281204 | A1 | 9/2016 | Ucasz | |
| 2017/0044901 | A1 | 2/2017 | Bacos et al. | |
| 2017/0145836 | A1 * | 5/2017 | Sivaramakrishnan | C23C 4/11 |
| 2018/0050964 | A1 | 2/2018 | McEvoy et al. | |
| 2018/0154381 | A1 * | 6/2018 | Bewlay | B05B 1/046 |
| 2018/0154392 | A1 | 6/2018 | Keshavan et al. | |
| 2019/0211696 | A1 | 7/2019 | Keshavan et al. | |
| 2019/0367190 | A1 | 12/2019 | Bewlay et al. | |
| 2021/0131305 | A1 * | 5/2021 | Keshavan | C23C 4/12 |
| 2021/0324201 | A1 * | 10/2021 | Ramaswamy | B05D 7/24 |

FOREIGN PATENT DOCUMENTS

| | | | | |
|---|---|---|---|---|
| EP | 1484427 | A2 * | 12/2004 | C23C 28/3215 |
| EP | 1832668 | A1 | 9/2007 | |
| EP | 2893148 | A2 | 7/2015 | |
| EP | 3508698 | A1 | 7/2019 | |
| EP | 2893148 | B1 | 10/2019 | |
| WO | 1996/031687 | A2 | 10/1996 | |
| WO | WO2015/116300 | A2 | 8/2015 | |

OTHER PUBLICATIONS

First Office Action for CN Application 2020112306140, dated Jun. 2, 2022. (Year: 2022).*

Bilge et al., CAMS-Resistant Plasma Sprayed Thermal Barrier Coatings Based on Y2O3-Stabilized ZrO2 with Al3+ and Ti4+ Solute Additions, Journal of Thermal Spray Technology, vol. 23, Issue 4, pp. 708-715, Apr. 2014.

Rai et al., CMAS-Resistant Thermal Barrier Coatings (TBC), International Journal of Applied Ceramic Technology, vol. 7, Issue 5, May 11, 2009, pp. 662-674.

Wortman et al., Thermal Barrier Coatings for Gas Turbine Use, Materials Science and Engineering, vol. 120-121, Part 2, Dec. 1989, pp. 433-440. Abstract Only.

Wu et al., Evaluation of Plasma Sprayed YSZ thermal Barrier Coatings with the CMAS Deposits Infiltration using Impedance Spectroscopy, Progress in Natural Science: Materials International, vol. 22, Issue 1, pp. 40-47, Feb. 2012.

* cited by examiner

RESTORATION COATING SYSTEM AND METHOD

PRIORITY INFORMATION

The present application claims priority to U.S. Provisional Patent Application Ser. No. 62/931,643 filed on Nov. 6, 2019 and to Indian Patent Application No. 202011007680 filed on Feb. 24, 2020.

FIELD

The subject matter described herein relates to systems that apply restoration coating materials to surfaces to repair coatings on the surfaces, such as thermal barrier coatings.

BACKGROUND

Thermal barrier coatings are typically used in articles that operate at or are exposed to high temperatures. Aviation turbines and land-based turbines, for example, may include one or more components protected by the thermal barrier coatings. Under normal conditions of operation, coated components may be susceptible to various types of damage, including erosion, oxidation, and attack from environmental contaminants.

For turbine components, environmental contaminant compositions of particular concern are those containing oxides of calcium, magnesium, aluminum, silicon, and mixtures thereof; dirt, ash, and dust ingested by gas turbine engines, for instance, are often made up of such compounds. These oxides often combine to form contaminant compositions comprising mixed calcium-magnesium-aluminum-silicon-oxide systems (Ca—Mg—Al—Si—O), hereafter referred to as "CMAS." At the high turbine operating temperatures, these environmental contaminants can adhere to the hot thermal barrier coating surface, and thus cause damage to the thermal barrier coating. For example, CMAS can form compositions that are liquid or molten at the operating temperatures of the turbines. The molten CMAS composition can dissolve the thermal barrier coating, or can fill its porous structure by infiltrating the pores, channels, cracks, or other cavities in the coating. Upon cooling, the infiltrated CMAS composition solidifies and reduces the coating strain tolerance, thus initiating and propagating cracks that may cause delamination and spalling of the coating material. This may further result in partial or complete loss of the thermal protection provided to the underlying metal substrate of the part or component. Further, spallation of the thermal barrier coating may create hot spots in the metal substrate leading to premature component failure. Premature component failure can lead to unscheduled maintenance as well as parts replacement resulting in reduced performance, and increased operating and servicing costs.

However, routine maintenance of a thermal barrier coating includes washing and reapplying the thermal barrier coating material onto the component. Such operations require either engine disassembly or an engine wash process such that a new thermal barrier coating can be applied onto the surface of the component(s). Such a disassembly processes, causes downtime in the engine leading to loss of service for extended periods of time. Alternatively, flushing the internal components of the engine with detergents and other cleaning agents can introduce other unwanted issues to the engine.

Therefore, a process is needed to extend the life of thermal barrier coatings, especially for continued operation of the hot section components of a gas turbine engine, while avoiding any disassembly and/or cleaning processes.

BRIEF DESCRIPTION

In accordance with one embodiment, a coated component of a gas turbine engine includes a substrate defining a surface, a thermal barrier coating deposited on the surface of the substrate, a region of the component where the thermal barrier coating has spalled from the substrate, a layer of environmental contaminant compositions formed on one or more of the thermal barrier coating or the region of the component where the thermal barrier coating has spalled in response to an initial exposure of the component to high operating temperatures of the gas turbine engine, and a thermal barrier coating (TBC) restoration coating deposited at least on the region of the component where there thermal barrier coating has spalled from the substrate.

In accordance with one or more embodiments, a method includes exposing a substrate of a coated component to high operating temperatures of a gas turbine engine. Exposing the substrate to the high operating temperatures of the gas turbine engine causes formation of a region of the component where a thermal barrier coating deposited on a surface of the substrate has spalled from the substrate and a layer of environmental contaminant compositions to form on one or more of the thermal barrier coating or the region of the component where the thermal barrier coating has spalled from the substrate. A layer of a thermal barrier coating (TBC) restoration coating is deposited at least on the region of the component where the thermal barrier coating has spalled from the substrate.

In accordance with one or more embodiments, a method includes exposing a substrate of a coated component to high operating temperatures of a gas turbine engine. Exposing the substrate to the high operating temperatures of the gas turbine engine causes a layer of environmental contaminant compositions to form on a thermal barrier coating deposited on a surface of the substrate of the gas turbine engine. A layer of a thermal barrier coating (TBC) restoration coating is deposited at least on a region of the component where the thermal barrier coating has spalled from the substrate. A reactive phase spray coating is applied at least on the TBC restoration coating. The environmental contaminant compositions comprise CMAS. The reactive phase spray coating provides protection to the TBC restoration coating against the environmental contaminant compositions.

In one or more embodiments, a coated component of a gas turbine engine includes a substrate defining a surface, a thermal barrier coating deposited on the surface of the substrate, a region of the component where the thermal barrier coating has spalled from the substrate, a layer of environmental contaminant compositions formed on one or more of the thermal barrier coating or the region of the component where the thermal barrier coating has spalled in response to an initial exposure of the component to high operating temperatures of the gas turbine engine, and a thermal barrier coating (TBC) restoration coating deposited at least on the region of the component where there thermal barrier coating has spalled from the substrate. The TBC restoration coating chemically reacts with the layer of the environmental contaminant compositions in response to a secondary exposure of the coated component to high operating temperatures of the gas turbine engine to form a protective layer.

DETAILED DESCRIPTION

Figure 1:
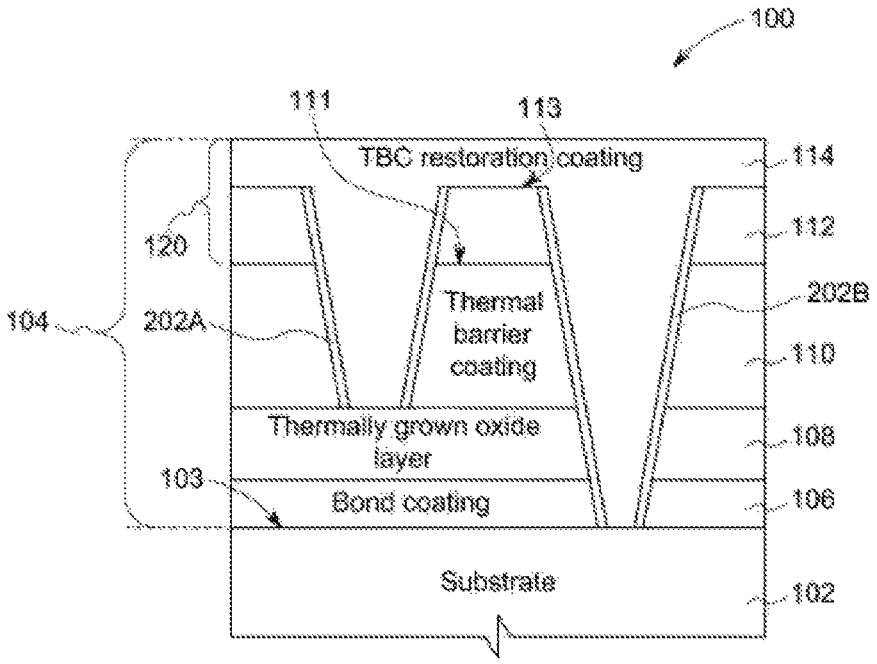
FIG. 1 illustrates one embodiment of a coated component having a thermal barrier coating (TBC) restoration coating on a layer of environmental contaminant compositions.

Reference now will be made in detail to embodiments of the invention, one or more example of which are illustrated in the drawings. Each example is provided by way of explanation of the invention, not limiting of the invention. It will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modification and variations as come within the scope of the appended claims and their equivalents.

As used herein, the terms "first," "second," and "third" may be used interchangeably to distinguish one component from another and are not intended to signify location or importance of the individual components.

As used herein, the term "coating" refers to a material disposed on at least a portion of an underlying surface in a continuous or discontinuous manner. Further, the term "coating" does not necessarily mean a uniform thickness of the disposed material, and the disposed material may have a uniform or a variable thickness. The term "coating" may refer to a single layer of the coating material or may refer to a plurality of layers of the coating material. The coating material may be the same or different in the plurality of layers. Additionally, the term "coating system" may refer to a system or group of materials disposed on at least a portion of an underlying surface in a continuous or discontinuous manner. As used herein, the term "restoration coating" may refer to a material that may restore or substantially restore the coating system that may be flawed, degraded, or the like. For example, the restoration coating may refer to a material that substantially restores a surface, system, material, or a combination therein, to an original state of the surface, system, material, or the like.

In the present disclosure, when a layer is being described as "on" or "over" another layer or substrate, it is to be understood that the layers can either be directly contacting each other or have another layer or feature between the layers, unless expressly stated to the contrary. Thus, these terms are simply describing the relative position of the layers to each other and do not necessarily mean "on top of" since the relative position above or below depends upon the orientation of the device to the viewer.

As used herein, the term "fusion temperature" refers to the degree of temperature at which a substance starts to melt (e.g., the incipient melting point). Since these materials generally have a complex, multi-component range of compositions, this fusion temperature could be measurably lower than the temperature at which a single-phase liquid zone would be realized.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

In one or more embodiments of the subject matter described herein, a coated component is generally provided that includes a refreshed thermal barrier coating, along with methods of its application and use. The coated component generally has a coating system to protect the underlying material (e.g., underlying coating and/or surfaces) from undesired chemical interactions. The coating system generally includes a thermal barrier coating (TBC) restoration coating positioned on any layer of environmental contaminant compositions present on the surface of a thermal barrier coating. As used herein, the term "layer of environmental contaminant compositions" may refer to a contamination layer formed during use of the component, and includes, for example, products formed by reaction of CMAS and the underlying thermal barrier coating.

The TBC restoration coating generally protects the underlying thermal barrier coating from CMAS attack by reacting with the existing layer of environmental contaminant compositions on its surface and/or by reacting with additional CMAS deposits formed on the TBC restoration coating after subsequent use of the component (e.g., after operation of an engine containing the component). At least one technical effect of the various embodiments herein can provide a coating system that includes the TBC restoration coating that may restore or substantially restore an original flow path surface of a component within an engine. For example, the TBC restoration coating may protect any bond coat, and particularly any thermally grown oxide on the bond coat, from CMAS attack, from particle erosion, or the like. The TBC restoration coating may be particularly useful on coating systems that include a thermal barrier coating after it has been used in service, and may include a plurality of surface-connected voids, such as cracks and porosity, which provides a path for CMAS attack, reactive particle attack, or a reactive layer attack.

Figure 2:
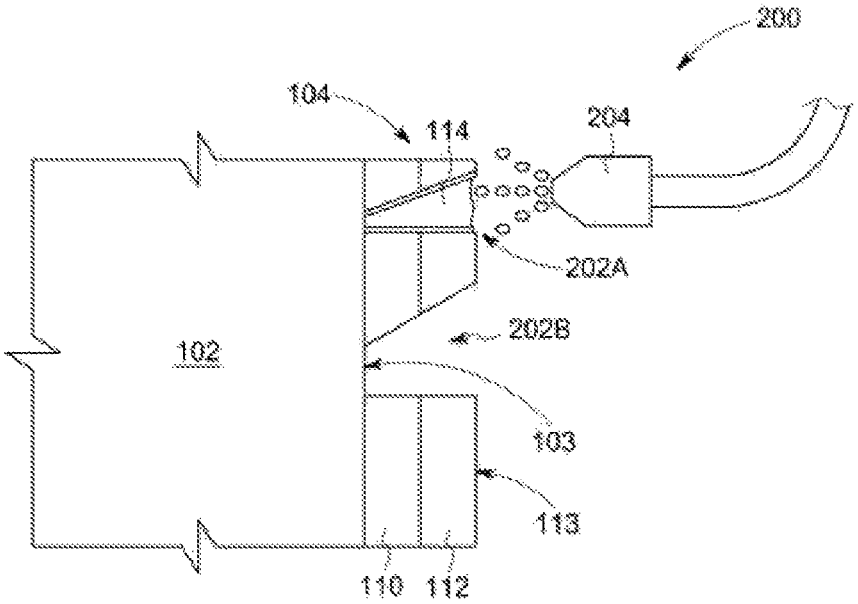
FIG. 2 illustrates one embodiment for applying the TBC restoration coating on the coated component shown in FIG. 1.

Referring to FIGS. 1 and 2, a coated component 100 is generally shown including a substrate 102 having a surface 103. In particular embodiments, the coated component 100 may be any article that is subject to service in a high-temperature environment, such as a component of a gas turbine engine assembly. Examples of such components include, but are not limited to, components that include turbine airfoils such as blades and vanes, and combustion components such as liners and transition pieces. Substrate 102 then, may be any material suitable for use in such applications, including, but not limited to, nickel-based superalloys, cobalt-base superalloys, and ceramic matrix composites.

As shown in FIG. 1, a coating system 104 is positioned on the surface 103 of the substrate 102. In the exemplary embodiment of FIG. 1, the coating system 104 includes a bond coat or bond coating 106 on the surface 103, a thermally grown oxide layer 108 on the bond coating 106, and a thermal barrier coat or thermal barrier coating 110 is on the thermally grown oxide layer 108.

The bond coating 106 provides functionality (e.g., adhesion promotion and oxidation resistance) similar to what such coatings generally provide in conventional applications. In some embodiments, bond coating 106 comprises an aluminide, such as nickel aluminide or platinum aluminide, or a MCrAlY-type coating. These bond coats may be especially useful when applied to a metallic substrate 102, such as a superalloy. The bond coating 106 may be applied using any of various coating techniques such as plasma spray, thermal spray, chemical vapor deposition, ion plasma deposition, vapor phase aluminide, physical vapor deposition, or the like.

The bond coating 106 may have a thickness of about 2.5 micro-meter (μm) to about 400 μm, and may be applied as an additive layer to the substrate 102 or may be diffused into the substrate 102 giving an inhomogeneous composition which is engineered to have a gradient in properties. However, it is noted that all coating layers within the coating system 104 may vary in thickness depending on location on the part.

A thermally grown oxide layer 108 is shown on the bond coating 106. Generally, the thermally grown oxide layer 108 may include an oxide material of the bond coating 106. For example, when the bond coating 106 includes aluminum in its construction, the thermally grown oxide layer 108 may include an aluminum oxide (e.g., $Al_2O$, AlO, $Al_2O_3$, mixtures thereof, or the like).

In one or more embodiments, the thermally grown oxide layer 108 may have a thickness of up to about 20 μm (e.g., about 0.01 μm to about 6 μm) and may be a natural product of thermal exposures during processing of subsequent layers of can be designed to be thicker by heat treating the part. The thermally grown oxide layer may not be uniform dependent on the underlying bond coating 106, processing methods, and exposing conditions.

As shown, a thermal barrier coating 110 may be over the bond coating 106 and the thermally grown oxide layer 108. In one or more embodiments, the bond coating 106 may have a thickness of about 250 μm. Optionally, the bond coating 106 may have a thickness that is greater than or less than 250 μm. Additionally, the thermally grown oxide layer 108 may have a thickness of about 100 μm. Optionally, the thermally grown oxide layer 108 may have a thickness that is greater than or less than 100 μm. The thermal barrier coating 110 may be applied by any technique suitable for a given application, such as via air plasma spray techniques, suspension plasma spray and other thermal spray processers, physical- or chemical-vapor deposition techniques, or the like. The thermal barrier coating 110 may generally include a ceramic thermal barrier material in one or more embodiments. For example, suitable ceramic thermal barrier coating materials may include various types of oxides, such as aluminum oxide ("alumina"), hafnium oxide ("hafnia"), or zirconium oxide ("zirconia"), in particular stabilized hafnia or stabilized zirconia, and blends including one or both of these. Examples of stabilized zirconia include without limitation yttria-stabilized zirconia, ceria-stabilized zirconia, calcia-stabilized zirconia, scandia-stabilized zirconia, magnesia-stabilized zirconia, india-stabilized zirconia, ytterbia-stabilized zirconia, lanthana-stabilized zirconia, gadolinia-stabilized zirconia, as well as mixtures of such stabilized zirconia. Similar stabilized hafnia compositions are known in the art and suitable for use in embodiments described herein.

In certain embodiments, the thermal barrier coating 110 may include yttria-stabilized zirconia. Suitable yttria-stabilized zirconia may include from about 1 weight percent to about 20 weight percent yttria (based on the combined weight of yttria and zirconia), and more typically from about 3 weight percent to about 10 weight percent yttria. An example of yttria-stabilized zirconia thermal barrier coating includes about 7% yttria and about 93% zirconia. These types of zirconia may further include one or more of a second metal (e.g., a lanthanide, actinide, or the like) oxide, such as dysprosia, erbia, europia, gadolinia, neodymian, praseodymia, urania, and hafnia, to further reduce thermal conductivity of the thermal barrier coating material. In one or more embodiments, the thermal barrier coating material may further include an additional metal oxide, such as titania and/or alumina. For example, the thermal barrier coating 110 may be composed of 8YSZ, though higher yttria concentrations may be utilized.

Suitable ceramic thermal barrier coating materials may also include pyrochlores of general formula $A_2B_2O_7$ where A is a metal having a valence of 3+ or 2+ (e.g., gadolinium, aluminum, cerium, lanthanum, or yttrium) and B is a metal having a valence of 4+ or 5+ (e.g., hafnium, titanium, cerium, or zirconium) where the sum of the A and B valences is 7. Representative materials of this type include gadolinium zirconate, lanthanum titanate, lanthanum zirconate, yttrium zirconate, lanthanum hafnate, cerium hafnate, and lanthanum cerate.

The thickness of the thermal barrier coating 110 may depend upon the substrate or the component it is deposited on. In some embodiments, the coating 110 has a thickness in a range of from about 25 micrometer (μm) to about 2000 μm. In some embodiments, the coating 110 has a thickness in a range of from about 25 μm to about 1500 μm. In some embodiments, the thickness is in a range of from about 25 μm to about 1000 μm.

After use of the component 100, such as within a hot gas path of a gas turbine engine, a layer 112 of environmental contaminant compositions form on a surface 111 of the thermal barrier coating 110. For example, the environmental contaminant compositions include oxides of calcium, magnesium, aluminum, silicon, and mixtures thereof; dirt, ash, and dust ingested by the gas turbine engine, for instance, are often made up of such compounds. As stated, these oxides often combine to form contaminant compositions comprising mixed calcium-magnesium-aluminum-silicon-oxide systems (Ca—Mg—Al—Si—O), hereafter referred to as "CMAS." At the high turbine operating temperatures, these environmental contaminants adhere to the hot surface 111 of the thermal barrier coating 110 to form the layer 112. In one or more embodiments, the layer 112 may have a thickness of about 10 μm to about 100 μm. Optionally, the layer 112 may have a thickness of about 25 μm to about 50 μm. Additionally or alternatively, the layer 112 may have a variable thickness at different positions or locations along the surface 111 of the thermal barrier coating 110.

In one or more embodiments, the component 100 may include one or more regions 202 where the thermal barrier coating 110 has spalled from the surface 103 of the substrate 102. Optionally, the thermal barrier coating 110 may have spalled at one or more regions at an interface between the bond coating 106 and the substrate 102. Optionally, the thermal barrier coating 110 may have spalled at an interface between the bond coating 106 and the thermally grown oxide layer 108. Optionally, the thermal barrier coating 110 may be comprised of plural different layers of the thermal barrier coating, and the coating 110 may have spalled at one or more layers of the thermal barrier coating 110 at any depth or distance away from the surface 111 of the thermal barrier coating 110. Optionally, the coated component 100 may include any number of different spall regions, and each of the different spall regions may spall at different interfaces of any of the different layers of coating of the coated component 100.

The thermal barrier coating 110 may have spalled responsive to the layer of the environmental contaminant compositions 112 infiltrating and deteriorating the thermal barrier coating 110. In another embodiment, the thermal barrier coating 110 may have spalled in one or more regions for one or more other reasons. The one or more regions where the thermal barrier coating 110 has spalled from the surface 103 of the substrate 102 exposes the surface 103 of the substrate 102. Exposure of the substrate 102 increases a risk of damage to the substrate 102.

As shown in the embodiment of FIG. 1, a thermal barrier coating (TBC) restoration coating 114 is applied directly on the layer 112 of the environmental contaminant compositions. The TBC restoration coating may be disposed on the component while the component is assembled within the gas turbine engine. The TBC restoration coating 114 may chemically react with the thermal barrier coating 110 and/or with the layer 112 of the environmental contaminant compositions response to operation of the gas turbine engine. The TBC restoration coating 114 provides thermal protection of the coated component 100. For example, the TBC restoration coating 114 has a thermal resistance that is compatible with a thermal resistance of the thermal barrier coating 110.

The TBC restoration coating 114 fills or substantially fills the regions 202 where at least the thermal barrier coating 110 has spalled from the surface 103 of the substrate 102. Additionally or alternatively, the TBC restoration coating 114 may be applied such that the TBC restoration coating 114 extends any distance around the regions 202. In the illustrated embodiment of FIG. 1, the TBC restoration coating 114 fills the regions 202 and forms a layer on the layer of the environmental contaminant compositions 112. Optionally, the TBC restoration coating 114 may be applied to the regions 202 to substantially fill the regions 202 and an area proximate each of the regions 202 on the layer of the environmental contaminant compositions 112. Optionally, the thermal barrier coating 110 may include one or more cracks, but may not spall away from the surface 103 of the substrate 102. For example, the TBC restoration coating 114 may substantially fill one or more regions or gaps of the thermal barrier coating 110. For example, the TBC restoration coating 114 may extend any distance from the layer 112 of the environmental contaminant compositions in a direction toward the substrate 102.

The TBC restoration coating 114 may be formed without any pre-washing or any other pre-treatment step. That is, the formation process can be formed without the use of any aqueous or organic precursors. In one or more embodiments, the TBC restoration coating 114 may chemically react with the layer of the environmental contamination compositions 112 in response to a secondary exposure of the coated component 100 to high operating temperatures of the gas turbine engine to form a protective layer 120. For example, the TBC restoration coating 114 may include one or more protective agents that are highly reactive to CMAS-type material, such that, at typical temperatures where CMAS is encountered in liquid form, the TBC restoration coating 114 rapidly reacts with the CMAS to form a solid reaction product that itself is thermally and chemically stable in the presence of liquid CMAS, forming a solid-phase barrier against further CMAS attack to the underlying layers (e.g., the underlying thermal barrier coating 110).

In particular, the "protective agent" may include a substance that is reactive with CMAS material. More particularly, a substance is considered suitable as a substance for use in the protective agent as described herein if the substance has the characteristic property. In certain embodiments, for instance, the protective agent may chemically react with a nominal CMAS liquid composition at atmospheric pressure to form a solid, crystalline product that is outside the crystallization field of this normal CMAS composition. Such a solid crystalline product may have a higher melting temperature than the nominal CMAS composition so that it remains as a solid barrier to liquid infiltration.

Additionally or alternatively, particles of the TBC restoration coating 114 may react (e.g., chemically, thermally, physically, or the like) with each other in response to the high operating temperatures of the gas turbine engine to form the protective layer. Optionally, the TBC restoration coating 114 may react with the bond coating 106, the thermal barrier coating 110, the substrate 102, the thermally grown oxide layer 108, or any combination of two or more different layers, to form the protective layer 120. Optionally, the TBC restoration coating 114 may react with one or more layers of the plural layers of the thermal barrier coating 110.

For the purposes of this description, the term "nominal CMAS" may refer to the following composition, with all percentages in mole percent: 41.6% silica ($SiO_2$), 29.3% calcia (CaO), 12.5% alumina ($AlO_{1.5}$), 9.1% magnesia (MgO), 6.0% iron oxide ($FeO_{1.5}$), and 1.5% nickel oxide (NiO). It will be appreciated that the nominal CMAS composition given this definition represents a reference composition to define a benchmark for the substance's CMAS reactivity in a way that can be compared to the CMAS reactivity of other substances; use of this reference composition does not limit in any way the actual composition of ingested material that becomes deposited on the coating during operation which, of course, will vary widely in service.

If a given substance is capable of reacting with molten CMAS having the above nominal composition, thereby forming a reaction product that has a melting point higher than about 1200° C., is crystalline, and is outside the crystallization field of this nominal CMAS composition, then the substance may be useful in the protective agent as described herein. A material is outside the crystallization field of the nominal CMAS composition if it is not included in the set of crystalline phases that can be formed from combinations of the component oxides of the CMAS composition. Thus, a material that includes a rare-earth element, such as ytterbium, for instance, would be outside the crystallization field of the nominal CMAS composition because none of the component oxides of the nominal CMAS includes ytterbium. On the other hand, a reactive agent that exclusively employs one or more of the other components of the nominal CMAS composition, such as aluminum oxide, would not form a product outside the crystallization field of nominal CMAS. Use of a protective agent substance that promotes formation of reaction product with CMAS outside the crystallization field of the CMAS may result in faster reaction kinetics with CMAS under some circumstances, and if reaction kinetics can be accelerated, then ingress of molten CMAS prior to reaction and solidification desirably may be reduced.

In one or more embodiments, the protective agent may include a rare-earth oxide, that is, an oxide compound that includes a rare-earth element as one of its constituent elements. As used herein, the terms "rare-earth" and "rare-earth element" are used interchangeably, and encompass elements of the lanthanide series, yttrium, and scandium. For example, in some embodiments, the oxide includes lanthanum, neodymium, erbium, cerium, gadolinium, or combinations including any one or more of these. Certain complex oxides, that is, oxide compounds that include more than one metal element constituent, have been shown in some circumstances to provide comparatively high reactivity with liquid CMAS. In particular embodiments, the oxide is a complex oxide that includes a rare-earth element and a transition metal element, such as zirconium, hafnium, titanium, or niobium, along with combinations of these. Zirconates, hafnates, titanates, and niobates that include lanthanum, neodymium, cerium, and/or gadolinium are examples of such complex oxides. A particular example is gadolinium zirconate. For example, the protective agents may include, in particular embodiments, alpha-$Al_2O_3$, 55YSZ, $GdAlO_3$, $SrGd_2Al_2O_7$ (SAG), etc., or combinations thereof.

The TBC restoration coating 114 may be formed via any suitable method. However, when performed in an on-wing restoration process (e.g., without dismantling of the turbine engine), certain practical restraints exist that inhibit the use of several traditional coating methods, such as thermal spraying, flowing, dipping, etc., that are not preferred coating methods. In particular embodiments, a simple room temperature processing of the TBC restoration coating 114 can be performed, such as via spraying, brushing, rolling, or the like. Referring to the embodiment of FIG. 2, a plurality of ceramic oxide particles 200 are shown being sprayed from a spray head 204 to apply the TBC restoration coating 114 directly on the surface 103 of the substrate 102 in the regions 202A, 202B where the thermal barrier coating 110 has spalled from the substrate 102. Optionally, the TBC restoration coating 114 may be applied in the regions 202A, 202B where the thermal barrier coating 110 has spalled, and applied to the areas proximate to the regions 202A, 202B (e.g., within a designated area threshold). The TBC restoration coating 114 may be a coating on top of the existing thermal barrier coating 110 as additional thermal protection for the substrate, the thermal barrier coating 110, the bonding layer, or the like. For example, the TBC restoration coating 114 may provide additional thermal protection to the thermal barrier coating in regions where the thermal barrier coating has not spalled from the substrate, and in regions where the thermal barrier coating has spalled from the substrate.

In one or more embodiments, the TBC restoration coating 114 is comprised of two classes of powders of two different size distributions. A first class of powder may be a filler or filler material, and a second class may be a binder or binder agent. The filler may be one or more powders that may be used to build the coating thickness. The greater the required coating thickness, more powders of larger mean particle size may be needed to build the TBC restoration coating 114. The filler powders may be low surface area powders that may be formed by fusing and/or crushing a ceramic material. For example, for a TBC restoration coating thickness of up to 10 mils or about 250 microns, a single filler may be sufficient. Optionally, a thickness that is greater than 250 microns may require two or more different powder fillers. The binder or binder agent may be a high surface area ceramic powder that may sinter at relatively low temperatures. For example, the temperature may be about 900° C. or less than 900° C. For example, the binder may provide coating cohesion and/or adhesion. Additionally. the binder powders may facilitate curing of the restoration coating during operation of the engine.

In one or more embodiments, the TBC restoration coating 114 may be comprised of at least one filler powder and at least one binder powder. A particle size of the filler powder may be different than a particle size of the binder powder. The binder particles may occupy interstitial spaces to provide the cohesion and substantially fill the interstices of the surface roughness of any of the layers, such as the bond coat, to provide adhesion. For example, the binder particles may act as a high temperature glue between the bond coat 106 and the filler particles. The surface roughness of a thermally sprayed bond coat or bond coating 106 may be less than 10 microns. The median particle size of the binder powder may be less than or about 2 microns. Depending on the coating thickness required, the filler powder may be made of particles having a range of multiple sizes. In one example, a median particle size of the filler powder may be from about 7 microns to about 9 microns. In another example, a first filler powder may have a median particle size from about 7 microns to about 9 microns, and a second filler powder may have a median particle size of about 20 microns.

In particular embodiments, the average particle size of the plurality of ceramic oxide particles 200 is about 90% of the surface roughness or less, such as about 1% to about 50% of the surface roughness (e.g., about 1% to about 30%). For example, if the thermal barrier coating 110 is a EB-PVD coating having a surface roughness that is about 1 μm to about 2.5 μm, then the average particle size of the ceramic oxide particles 200 may be about 0.75 μm of less (e.g., about 0.1 μm to about 0.5 μm). In particular embodiments, the ceramic oxide particles 200 may have an average particle size of about 0.1 μm to about 10 μm (e.g., about 0.5 μm to about 5 μm, such as about 1 μm to about 3 μm).

In one or more embodiments, the TBC restoration coating 114 has a microstructure formed according to its method of deposition and formation. This microstructure is not typical of any conventionally used thermal barrier coatings. For example, if sprayed onto the layer 112 in the form of the ceramic oxide particles 200, the microstructure of the TBC restoration coating 114 is distinguished from other methods of formation (such as Air Plasma Spraying (APS), Electron Beam Physical Vapor Deposition (EBPVD), Suspension Plasma Spraying (SPS), Solution Precursor Plasma Spraying (SPPS), or Chemical Vapor Deposition (CVD)). For instance, the TBC restoration coating 114 is polycrystalline (as opposed to a columnar coating formed via EBPVD that has single crystalline columns), has an equiaxed microstructure with a grain size of about 2 μm without any splats (as opposed to an APS coating formed from splatted particles), without any vertical boundaries or micro-cracks that are substantially oriented perpendicular to the surface 111 (as opposed to SPS, SPPS, and high-temperature/velocity) and has porosity, as deposited, greater than 10% by volume of the TBC restoration coating 114. Such a TBC restoration coating 114 can be formed to any suitable porosity (e.g., a porosity of about 20% to about 50% by volume, as deposited). In one embodiment, the TBC restoration coating 114 may have a porosity of about 5% to about 50%. In a more preferred embodiment, the TBC restoration coating 114 may have a porosity of about 5% to about 30%. Optionally, the TBC restoration coating 114 may have an alternative porosity.

The thickness of the TBC restoration coating 114 may depend on the substrate 102, on the component 100, on the regions 202 where the thermal barrier coating 110 has spalled from the substrate 102, or any combination therein. In one embodiment, the TBC restoration coating 114 has a thickness that is greater than the surface roughness of the underlying thermal barrier coating 110, in particular, the regions of where the thermal barrier coating 110 has spalled, such that the TBC restoration coating 114 covers all of the surface 111 and may fill all of the regions 202. For example, the TBC restoration coating 114 relies on the roughness of the regions where the thermal barrier coating has spalled to which the TBC restoration coating 114 is applied to have a low temperature strength. The TBC restoration coating 114 may react with the thermal barrier coating 110 to form chemical bonds at increased temperatures (e.g., operating temperatures of the engine). In one or more embodiments, the surface roughness of the thermal barrier coating 110 may be about 0.5 μm to about 10 μm, and in particular embodiments, the TBC restoration coating 114 has a thickness that is greater than the surface roughness of the thermal barrier coating 110. Optionally, the surface roughness of the thermal barrier coating 110 may be greater than about 1 micron. In one embodiment, the thickness of the TBC restoration coating 114 may be from about 50 microns to about 2000 microns. In a preferred embodiment, the thickness of the coating 114 may be from about 50 microns to about 250 microns. In a more preferred embodiment, the thickness of the TBC restoration coating 114 may be from about 100 microns to about 250 microns. Optionally, the thickness of the TBC restoration coating 114 may vary based on a size and/or depth of each of the regions 202. For example, the TBC restoration coating 114 may have a first thickness at the first region 202A that is less than a thickness of the TBC restoration coating 114 at the second region 202B. For example, the thickness of the TBC restoration coating 114 may vary based on the degree of spallation between two surfaces of the coating system 104 where spalling has occurred.

In one or more embodiments, the TBC restoration coating 114 may be formed by a single application of a layer, or via multiple layers applied onto each other. In some embodiments, the TBC restoration coating 114 is about 2 times to about 8 times thicker than the layer 112 of the environmental contaminant compositions to provide sufficient material to react with the existing environmental contaminant compositions and to serve as a protective layer for future deposits. Optionally, the TBC restoration coating 114 may have a thickness that is about the same as a thickness of the layer 112, or the TBC restoration coating 114 may have a thickness that is less than a thickness of the layer 112. Additionally or alternatively, the TBC restoration coating 114 may have a thickness that is about 50% of the thickness of the original thermal barrier coating 110, a thickness that is about 80% of the thickness of the original thermal barrier coating 110, or the like.

Known embodiments of conventional coating systems may include protective layers that may include the thermal barrier coating or additional layers formed on top of thermal barrier coatings. A thickness of these known protective layers may be restricted to be thinner than about 250 μm due to the possibility that layers over 250 μm are more prone to spalling.

Alternatively, unlike conventional embodiments of protective layers deposited onto thermal barrier coatings, the TBC restoration coating 114 of the present invention may have a thickness that is greater than 250 μm and may not be prone to spalling. For example, the TBC restoration coating 114 may have a thickness of about 50 μm to about 2000 μm in one embodiment. In a preferred embodiment, the TBC restoration coating 114 may have a thickness that is from about 50 μm to about 500 μm. In a more preferred embodiment, the TBC restoration coating 114 may have a thickness that is from about 100 μm to about 250 μm.

In one or more embodiments, the TBC restoration coating 114 is a continuous coating that covers substantially all of the surface 113 of the layer 112 of the environmental contaminant compositions so as to avoid exposure of any particular area of the surface 113 to additional CMAS attack. Optionally, the TBC restoration coating 114 may be a discontinuous layer that may be applied within the regions 202 where the thermal barrier coating has spalled and proximate to the regions 202 where the thermal barrier coating has spalled. For example, the placement of the TBC restoration coating 114 may be in specific target regions to reduce an amount of the TBC restoration coating 114 that may be applied to the layer 112.

In one or more embodiments, the TBC restoration coating 114 and the layer 112 of environmental contaminant composition that forms, after continued operation of the engine, form a protective layer 120. For example, a first or initial exposure of the coated component 100 to the high operating temperatures of the gas turbine engine may cause the layer 112 of the environmental contaminants to form on the thermal barrier coating 110 (e.g., an initial or previous layer of dust and/or contaminants). The TBC restoration coating 114 is applied onto the layer 112, and a second, or subsequent exposure of the coated component 100 to high operating temperatures of the gas turbine engine (e.g., second operation of the engine cycle) may cause the TBC restoration coating 114 to chemically react with the layer 112 (e.g., the previous layer of dust and/or contaminants). Additionally, the second operation of the engine may cause another layer 112 of environmental contaminant composition to form on the TBC restoration coating 114 (e.g., a subsequent layer of dust and/or contaminants). The subsequent or second layer 112 may also react with the TBC restoration coating 114 during the second operation of the engine cycle.

Figure 3:
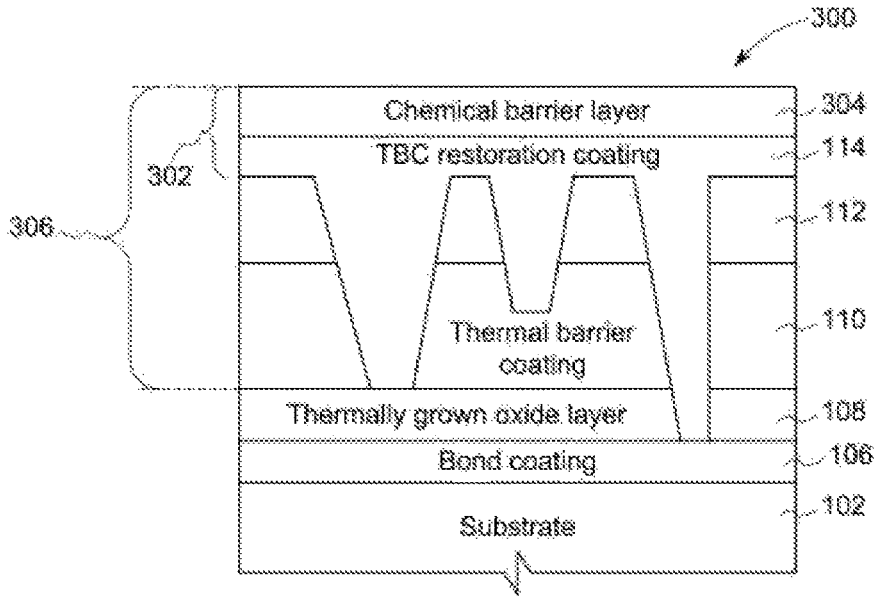
FIG. 3 illustrates one embodiment of a coated component having a TBC restoration coating and a chemical barrier layer formed on a coated component.

FIG. 3 illustrates a coated component 300 in accordance with another embodiment. Like the coated component 100 illustrated in FIGS. 1 and 2, the coated component 300 is generally shown including a substrate 102 having a surface 103. In particular embodiments, the coated component 100 may be any article that is subject to service in a high-temperature environment, such as a component of a gas turbine engine assembly. Examples of such components include, but are not limited to, components that include turbine airfoils such as blades and vanes, and combustion components such as liners and transition pieces. Substrate 102 then, may be any material suitable for use in such applications, including, but not limited to, nickel-based superalloys, and cobalt-base superalloys.

A coating system 306 is positioned on the surface 103 of the substrate 102. Similar to the coating system 104 illustrated in FIG. 1, the coating system 306 includes the thermally grown oxide layer 108 on the substrate 102, the thermal barrier coating 110 on the thermally grown oxide layer 108, the layer 112 of the environmental contaminant compositions, and the TBC restoration coating 114 deposited onto the layer 112 of the environmental contaminant compositions and at least on the regions 202 of the coated component 300 where the thermal barrier coating 110 has spalled from the substrate 102.

Unlike the coating system 104 illustrated in FIG. 1, the coating system 306 also includes a chemical barrier layer 304 that may be deposited onto the TBC restoration coating. As one example, the chemical barrier layer 304 may be a reactive phase spray coating. The TBC restoration coating 114 with the chemical barrier layer 304 may form and/or provide a protective layer 302. For example, the chemical barrier layer 304 may chemically react with the CMAS of the layer 112 of the environmental contaminant compositions to form the protective layer 302 in response to operation of the gas turbine engine at the high operating temperatures. The chemical barrier layer 304 may provide protection to the TBC restoration coating 114 against environmental contaminant compositions, against spalling of the TBC restoration coating 114, or the like.

A thickness of the chemical barrier layer 304 may depend upon the substrate 102 or the component on which it is deposited. In one embodiment, the chemical barrier layer 304 may have a thickness that is greater than the surface roughness of the underlying TBC restoration coating 114, such that the chemical barrier layer 304 covers all of the surface of the TBC restoration coating 114. For example, the surface roughness of the TBC restoration coating 114 may be from about 1 μm to about 10 μm, may be from about 5 μm to about 15 μm, may be from about 5 μm to about 50 μm, or the like. Additionally, the chemical barrier layer 304 may have a thickness that is greater than the surface roughness of the TBC restoration coating 114 (e.g., the chemical barrier layer 304 may be from about 5 microns to about 500 microns thick, from about 10 microns to about 250 microns thick, from about 50 microns to about 250 microns thick, or the like).

The thickness of the chemical barrier layer 304 may also depend upon the thickness of the underlying TBC restoration coating 114, the thickness of the layer 112 of the environmental contaminant compositions, and/or the thickness of the thermal barrier coating. The chemical barrier layer 304 may be formed by a single application of a layer, or via multiple layers applied onto each other. In some embodiments, the chemical barrier layer 304 may be about 2 times to about 8 times thicker than the layer 112 of the environmental contaminant compositions (e.g., the layer 112 has a thickness that is about ½ to about $\frac{1}{8}^{th}$ of the thickness of the chemical barrier layer 304). Optionally, the chemical barrier layer 304 may have a thickness that is about the same as the thickness of the layer 112. Optionally, the chemical barrier layer 304 may have a thickness that is less than or thinner than the thickness of the layer 112.

In one or more embodiments, the chemical barrier layer 304 is a continuous coating that covers substantially all of the surface of the TBC restoration coating 114 so as to avoid exposure of any particular area of the surface of the TBC restoration coating to additional CMAS attack. For example, the chemical barrier layer 304 may provide protection to the TBC restoration coating 114 against additional environmental contaminant compositions. The chemical barrier layer 304, or any reactive phase spray coating on the TBC restoration coating 114, may provide the TBC restoration coating 114 with increased CMAS resistance.

The chemical barrier layer 304 may also include a protective agent that may comprise a ceramic oxide that includes alumina, a rare-earth element (as previously described), or a mixture thereof. In one or more embodiments, the chemical barrier layer 304 and the layer 112 of the environmental contaminant compositions form, after continued operation of the gas turbine engine, the protective layer 302 on the TBC restoration coating 114. The protective layer 302 has a fusion temperature that is greater than a fusion temperature of the environmental contaminant compositions in the layer 112. For example, the protective layer 302 may have a fusion temperature that is about 0.1% to about 25% greater than the fusion temperature of the environmental contaminant compositions prior to formation of the protective layer 302. In one or more embodiments, the protective layer may have a fusion temperature that is about 0.5% to about 10% greater that the fusion temperature of the environmental contaminant compositions prior to formation of the protective layer 302.

Since CMAS attack is a continuous process during use of the component 100, the TBC restoration coating 114 would be a consumable coating requiring refreshing. The refresh frequency may depend on several conditions, such as the amount of CMAS in the layer 112, the amount of future deposits of CMAS on the TBC restoration coating 114, or on the chemical barrier layer 304, the length of service of the component, or the like.

As previously stated, the TBC restoration coating 114 is particularly useful on a surface of a hot gas path component within a turbine engine. For example, the coated component 100 and/or 300 may be utilized in turbomachinery in general, including a high-by-pass turbofan jet engine ("turbofan"), turbojet, turboprop, and/or turboshaft gas turbine engines, including industrial and marine gas turbine engines and auxiliary power units. For example, the coated component 100 can be in the hot gas path, such as within a combustion section (e.g., combustion liners), a turbine section (e.g., turbine nozzles and/or blades), or the like.

Figure 4:
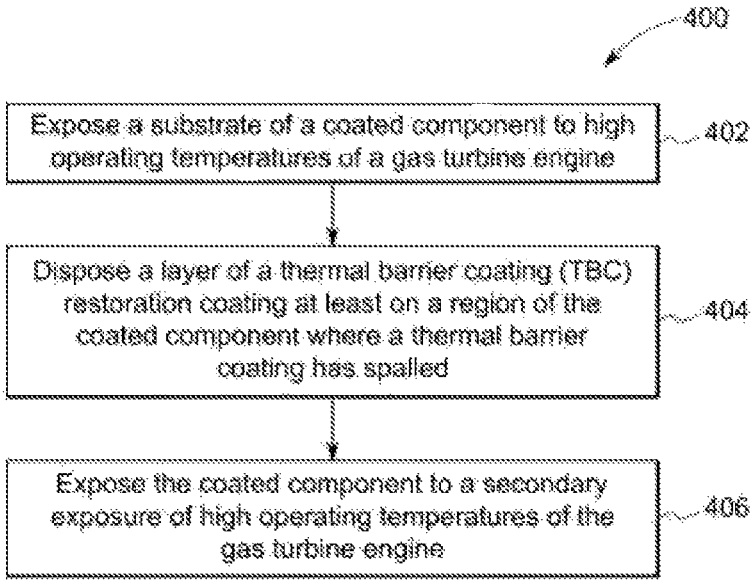
FIG. 4 illustrates a flowchart of a method for curing a TBC restoration coating using an engine cycle.

FIG. 4 illustrates one embodiment of a flowchart 400 of a method for curing a TBC restoration coating on a component in accordance with one embodiment. The component may be a hot gas path component of a gas turbine engine.

At 402, a substrate of a coated component is exposed to high operating temperatures of a gas turbine engine. Exposing the substrate to the high operating temperatures causes a layer of environmental contaminant compositions to form on a thermal barrier coating deposited on a surface of the substrate. The layer of the environmental contaminant compositions may deteriorate the thermal barrier coating, and may cause one or more regions of the thermal barrier coating to spall from the surface of the substrate, may cause one or more cracks to form in the thermal barrier coating, or the like. Exposure of the substrate 102 increases a risk of damage to the substrate 103.

At 404, a layer of a thermal barrier coating (TBC) restoration coating may be disposed onto a least a region of the coated component where the thermal barrier coating has spalled. Disposing the TBC restoration coating may occur within the gas turbine engine. The TBC restoration coating may be applied as a continuous layer that may cover a substantial amount of the thermal barrier coating, including the spalled regions, may be targeted to apply to the spalled regions and the areas proximate the spalled regions, or any combination therein. Optionally, the TBC restoration coating may be applied a single layer of coating, or may be applied as several layers of coating on top of each other. The TBC restoration coating substantially fills in the spalled regions of the thermal barrier coating to substantially fill the spalled regions.

At 406, the coated component is exposed to a secondary exposure of high operating temperatures of the gas turbine engine. Exposing the TBC restoration coating to the high operating temperatures causes the TBC restoration coating to chemically react with a layer of the environmental contaminant compositions to form a protective layer over the thermal barrier coating.

Optionally, in one or more embodiments, a reactive phase spray coating may be applied to the TBC restoration coating. The reactive phase spray coating may be a chemical barrier layer that may provide protection to the TBC restoration coating against environmental contaminant compositions.

For example, the environmental contamination compositions include CMAS, and the chemical barrier layer may provide CMAS protection and/or resistance against the CMAS of the environmental contamination compositions.

In one or more embodiments of the subject matter described herein, a coated component of a gas turbine engine includes a substrate defining a surface, a thermal barrier coating deposited on the surface of the substrate, a region of the component where the thermal barrier coating has spalled from the substrate, a layer of environmental contaminant compositions formed on one or more of the thermal barrier coating or the region of the component where the thermal barrier coating has spalled from the substrate in response to an initial exposure of the component to high operating temperatures of the gas turbine engine, and a thermal barrier coating (TBC) restoration coating deposited at least on the region of the component where there thermal barrier coating has spalled from the substrate.

Optionally, the TBC restoration coating provides thermal protection of the component.

Optionally, the TBC restoration coating has a thermal resistance that is compatible with a thermal resistance of the thermal barrier coating.

Optionally, the coated component may include a chemical barrier layer disposed on the TBC restoration coating.

Optionally, the chemical barrier layer may provide protection against the environmental contaminant compositions.

Optionally, the chemical barrier layer may have a thickness of about 5 microns to about 500 microns.

Optionally, the chemical barrier layer may include a protective agent. The protective agent includes a ceramic oxide that includes alumina, a rare-earth element, or a mixture thereof.

Optionally, the thermal barrier coating defines a surface having a surface roughness.

Optionally, the surface roughness of the thermal barrier coating is greater than about 1 micron.

Optionally, the TBC restoration coating may have a porosity of about 5% to about 30%.

Optionally, the coated component may include a bond coating positioned on the surface of the substrate between the substrate and the thermal barrier coating. The TBC restoration coating may react with the bond coating in response to the operation of the gas turbine engine.

Optionally, the coated component is a hot gas path of the gas turbine engine. The TBC restoration coating reacts with the thermal barrier coating responsive to operation of the gas turbine engine.

Optionally, the coated component also includes a chemical barrier layer deposited on the TBC restoration coating. The chemical barrier coating and the environmental contaminant compositions form the protective layer responsive to operation of the gas turbine engine. The protective layer has a fusion temperature that is greater than a fusion temperature of the environmental contaminant compositions.

Optionally, the region of the component where the thermal barrier coating has spalled from the substrate is a first region. The coated component including plural regions where the thermal barrier coating has spalled from the substrate.

Optionally, the first region where the thermal barrier coating has spalled extends a first distance away from a surface of the thermal barrier coating. A second region where the thermal barrier coating has spalled extends a second distance away from the surface of the thermal barrier coating.

Optionally, the thermal barrier coating may include plural layers of the thermal barrier coating. The region of the component where the thermal barrier coating has spalled from the substrate is at an interface between two of the plural layers of the thermal barrier coating.

In one or more embodiments of the subject matter described herein, a method includes exposing a substrate of a coated component to high operating temperatures of a gas turbine engine. Exposing the substrate to the high operating temperatures of the gas turbine engine causes formation of a region of the component where a thermal barrier coating deposited on a surface of the substrate has spalled from the substrate and a layer of environmental contaminant compositions to form on one or more of the thermal barrier coating or the region of the component where the thermal barrier coating has spalled from the substrate. A layer of a thermal barrier coating (TBC) restoration coating is deposited at least on a region of the component where the thermal barrier coating has spalled from the substrate.

Optionally, the TBC restoration coating may react with the thermal barrier coating of the coated component responsive to a secondary exposure of the component to the high operating temperatures.

Optionally, the method may also include depositing a chemical barrier layer on the TBC restoration coating.

Optionally, the environmental contaminant compositions comprise CMAS. The chemical barrier layer may provide protection against the environmental contaminant compositions.

Optionally, the chemical barrier layer may react with the layer of the environmental contaminant compositions.

Optionally, the chemically barrier layer may include a protective agent. The protective agent includes a ceramic oxide that includes alumina, a rare-earth element, or a mixture thereof.

Optionally, the layer of the TBC restoration coating is a first layer of the TBC restoration coating. The method may include disposing plural layers of the TBC restoration coating on the layer of the environmental contaminant compositions.

In one or more embodiments of the subject matter described herein, a method includes exposing a substrate of a coated component to high operating temperatures of a gas turbine engine. Exposing the substrate to the high operating temperatures of the gas turbine engine causes a layer of environmental contaminant compositions to form on a thermal barrier coating deposited on a surface of the substrate of the gas turbine engine. A layer of a thermal barrier coating (TBC) restoration coating is deposited at least on a region of the component where the thermal barrier coating has spalled from the substrate. A reactive phase spray coating is applied at least on the TBC restoration coating. The environmental contaminant compositions comprise CMAS. The reactive phase spray coating provides protection to the TBC restoration coating against the environmental contaminant compositions.

Optionally, disposing the TBC restoration coating includes disposing a plurality of layers of the TBC restoration coating onto the component.

Optionally, the TBC restoration coating at least on the region of the component where the thermal barrier coating has spalled from the substrate has a thickness that is about the same as a thickness of the thermal barrier coating.

Optionally, the TBC restoration coating at least on the region of the component where the thermal barrier coating has spalled from the substrate has a thickness that is less than a thickness of the thermal barrier coating.

Optionally, the method may include depositing a chemical barrier layer on the TBC restoration coating.

Optionally, the reactive phase spray coating may include a protective agent. The protective agent includes a ceramic oxide that includes alumina, a rare-earth element, or a mixture thereof.

In one or more embodiments of the subject matter described herein, a coated component of a gas turbine engine includes a substrate defining a surface, a thermal barrier coating deposited on the surface of the substrate, a region of the component where the thermal barrier coating has spalled from the substrate, a layer of environmental contaminant compositions formed on one or more of the thermal barrier coating or the region of the component where the thermal barrier coating has spalled in response to an initial exposure of the component to high operating temperatures of the gas turbine engine, and a thermal barrier coating (TBC) restoration coating deposited at least on the region of the component where there thermal barrier coating has spalled from the substrate. The TBC restoration coating may chemically react with the layer of the environmental contaminant compositions in response to a secondary exposure of the coated component to high operating temperatures of the gas turbine engine to form a protective layer.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A coated component of a gas turbine engine, the coated component comprising:

a substrate defining a surface;

a thermal barrier coating deposited on the surface of the substrate;

a region of the component where the thermal barrier coating has spalled from the substrate;

a layer of environmental contaminant compositions formed on one or more of the thermal barrier coating or the region of the component where the thermal barrier coating has spalled in response to an initial exposure of the component to high operating temperatures of the gas turbine engine; and a thermal barrier coating (TBC) restoration coating deposited at least on the region of the component where the thermal barrier coating has spalled from the substrate;

wherein the coated component is in a hot gas path of the gas turbine engine, wherein the TBC restoration coating is configured to react with the thermal barrier coating in response to operation of the gas turbine engine.

2. The coated component of claim 1, wherein the TBC restoration coating is configured to provide thermal protection of the component.

3. The coated component of claim 1, further comprising a chemical barrier layer deposited on the TBC restoration coating, wherein the chemical barrier layer is configured to provide protection against the environmental contaminant compositions, and wherein the chemical barrier layer has a thickness from 5 microns to 500 microns.

4. The coated component of claim 3, wherein the chemical barrier layer includes a protective agent, wherein the protective agent comprises a ceramic oxide that includes alumina, a rare-earth element, or a mixture thereof.

5. The coated component of claim 1, wherein the thermal barrier coating defines a surface having a surface roughness, wherein the surface roughness of the thermal barrier coating is greater than 1 micron.

6. The coated component of claim 1, wherein the TBC restoration coating has a porosity of 5% to 30%.

7. The coated component of claim 1, further comprising:

a chemical barrier layer deposited on the TBC restoration coating, wherein the chemical barrier layer and the environmental contaminant compositions are configured to form a protective layer in response to operation of the gas turbine engine, wherein the protective layer has a fusion temperature that is greater than a fusion temperature of the environmental contaminant compositions.

8. The coated component of claim 1, wherein the region of the component where the thermal barrier coating has spalled from the substrate is a first region, the coated component further comprising plural regions where the thermal barrier coating has spalled from the substrate, wherein the first region where the thermal barrier coating has spalled extends a first distance away from a surface of the thermal barrier coating, and wherein a second region where the thermal barrier coating has spalled extends a second distance away from the surface of the thermal barrier coating.

9. The coated component of claim 1, wherein the thermal barrier coating comprises plural layers of the thermal barrier coating, wherein the region of the component where the thermal barrier coating has spalled from the substrate is at an interface between two of the plural layers of the thermal barrier coating.

10. A coated component of a gas turbine engine, the coated component comprising:

a substrate defining a surface;

a thermal barrier coating deposited on the surface of the substrate;

a region of the component where the thermal barrier coating has spalled from the substrate;

a layer of environmental contaminant compositions configured to form on one or more of the thermal barrier coating or the region of the component where the thermal barrier coating has spalled in response to an initial exposure of the component to high operating temperatures of the gas turbine engine;

a thermal barrier coating (TBC) restoration coating configured to be deposited at least on the region of the component where the thermal barrier coating has spalled from the substrate; and a bond coating positioned on the surface of the substrate between the substrate and the thermal barrier coating, wherein the TBC restoration coating is configured to react with the bond coating in response to operation of the gas turbine engine.

11. A method comprising:

exposing a substrate of a coated component to high operating temperatures of a gas turbine engine, wherein the exposing of the substrate to the high operating temperatures of the gas turbine engine causes formation of a region of the component where a thermal barrier coating deposited on a surface of the substrate has spalled from the substrate and a layer of environmental contaminant compositions formed on one or more of the thermal barrier coating or the region of the component where the thermal barrier coating has spalled from the substrate; and disposing a layer of a thermal barrier coating (TBC) restoration coating at least on the region of the component where the thermal barrier coating has spalled from the substrate, wherein disposing the layer of the TBC restoration coating at least on the region of the component where the thermal barrier coating has spalled from the substrate occurs within the gas turbine engine;

wherein the TBC restoration coating is configured to react with the thermal barrier coating of the coated component responsive to a secondary exposure of the component to the high operating temperatures.

12. The method of claim 11, further comprising:

depositing a chemical barrier layer on the TBC restoration coating, wherein the chemical barrier layer is configured to provide protection against the layer of the environmental contaminant compositions.

13. The method of claim 11, further comprising:

depositing a chemical barrier layer on the TBC restoration coating, wherein the chemical barrier layer includes a protective agent, wherein the protective agent comprises a ceramic oxide that includes alumina, a rare-earth element, or a mixture thereof.

14. The method of claim 11, wherein the layer of the TBC restoration coating is a first layer of the TBC restoration coating, the method further comprising:

disposing plural layers of the TBC restoration coating on the layer of the environmental contaminant compositions.

15. A method comprising:

exposing a substrate of a coated component to high operating temperatures of a gas turbine engine, wherein exposing the substrate to the high operating temperatures of the gas turbine engine causes a layer of environmental contaminant compositions to form on a thermal barrier coating deposited on a surface of the substrate of the gas turbine engine;

disposing a layer of a thermal barrier coating (TBC) restoration coating at least on a region of the component where the thermal barrier coating has spalled from the substrate, wherein disposing the layer of the TBC restoration coating at least on the region of the component where the thermal barrier coating has spalled from the substrate occurs within the gas turbine engine wherein the TBC restoration coating is configured to react with the thermal barrier coating of the coated component responsive to a secondary exposure of the component to the high operating temperatures; and applying a reactive phase spray coating at least on the TBC restoration coating, wherein the environmental contaminant compositions comprises CMAS, wherein the reactive phase spray coating is configured to provide protection to one or more of the TBC restoration coating or the thermal barrier coating against the environmental contaminant compositions.

16. The method of claim 15, wherein disposing the layer of the TBC restoration coating includes disposing a plurality of layers of the TBC restoration coating onto the component, wherein the TBC restoration coating at least on the region of the component where the thermal barrier coating has spalled from the substrate has a thickness that is the same as a thickness of the thermal barrier coating.

17. The method of claim 15, wherein the TBC restoration coating at least on the region of the component where the thermal barrier coating has spalled from the substrate has a thickness that is less than a thickness of the thermal barrier coating.

18. The method of claim 15, wherein the reactive phase spray coating includes a protective agent, wherein the protective agent comprises a ceramic oxide that includes alumina, a rare-earth element, or a mixture thereof.

* * * * *